US011466483B2

(12) United States Patent
Yamane

(10) Patent No.: US 11,466,483 B2
(45) Date of Patent: Oct. 11, 2022

(54) VEHICLE DOOR LOCK DEVICE

(71) Applicant: AISIN CORPORATION, Kariya (JP)

(72) Inventor: Ryohei Yamane, Takahama (JP)

(73) Assignee: AISIN COPORATION, Aichi (JP)

( * ) Notice: Subject to any disclaimer, the term of this patent is extended or adjusted under 35 U.S.C. 154(b) by 979 days.

(21) Appl. No.: 16/182,071

(22) Filed: Nov. 6, 2018

(65) Prior Publication Data

US 2019/0161994 A1 May 30, 2019

(30) Foreign Application Priority Data

Nov. 24, 2017 (JP) ..... JP2017-225956

(51) Int. Cl.
*E05B 79/22* (2014.01)
*E05B 15/16* (2006.01)
(Continued)

(52) U.S. Cl.
CPC ..... *E05B 79/22* (2013.01); *E05B 15/1635* (2013.01); *E05B 17/0054* (2013.01); *E05B 77/22* (2013.01); *E05B 77/42* (2013.01)

(58) Field of Classification Search
CPC .. E05B 79/22; E05B 17/0054; E05B 15/1635; E05B 77/42; E05B 81/54;
(Continued)

(56) References Cited

U.S. PATENT DOCUMENTS 4,826,222 A * 5/1989 Davis ..... E05C 3/10 292/197
5,894,749 A * 4/1999 Tomaszewski ..... E05B 83/16 70/240
(Continued)

FOREIGN PATENT DOCUMENTS

DE 4408910 A1 * 9/1995 ..... E05B 13/105
DE 102015008357 A1 * 12/2016
(Continued)

OTHER PUBLICATIONS

Resin. (2016). In Editors of the American Heritage Dictionaries (Ed.), The American Heritage (R) dictionary of the English language (6th ed.). Houghton Mifflin. Credo Reference: https://search.credoreference.com/content/entry/hmdictenglang/resin/0?institutionId=743 (Year: 2016).*
(Continued)

*Primary Examiner* — Kristina R Fulton
*Assistant Examiner* — Emily G. Brown
(74) *Attorney, Agent, or Firm* — Buchanan Ingersoll & Rooney PC

(57) ABSTRACT

A vehicle door lock device includes: a remote control device that is provided in the middle of an operation transmitting system between a lock device, which binds a door of a vehicle such that the door becomes not able to move, and a door handle, in which a connection member that absorbs an excessive operation force by being elastically deformed in a direction in which the operation force is transmitted is interposed between a transmitting member that transmits an operation force input to the door handle and an input lever on the remote control device side to which the operation force is input via the transmitting member.

5 Claims, 3 Drawing Sheets

(51) Int. Cl.
*E05B 77/22* (2014.01)
*E05B 17/00* (2006.01)
*E05B 77/42* (2014.01)

(58) Field of Classification Search
CPC .. E05B 15/04; E05B 79/10; E05B 2015/0458; Y10T 292/1076; Y10T 292/57; Y10S 292/38
See application file for complete search history.

(56) References Cited

U.S. PATENT DOCUMENTS 5,934,817 A * 8/1999 Kim ..... F16B 2/22 292/336.3
6,647,594 B1 * 11/2003 Deb ..... B60N 3/026 16/410
6,880,867 B2 * 4/2005 Schoen ..... E05B 77/06 292/216
8,701,817 B2 * 4/2014 Schoen ..... E05B 79/22 180/281
8,746,758 B2 * 6/2014 Savant ..... E05B 77/06 292/336.3
9,045,917 B2 * 6/2015 Gschweng ..... E05B 85/10
2015/0204113 A1 7/2015 Machida et al.
2016/0265256 A1 * 9/2016 Strathmann ..... E05B 85/26
2019/0136586 A1 * 5/2019 Han ..... E05B 79/20

FOREIGN PATENT DOCUMENTS

JP S61-198463 U 12/1986
JP 2013-133639 A 7/2013
JP 2014066082 A 4/2014
JP 2014177800 A 9/2014

OTHER PUBLICATIONS

Collins English Dictionary, "offset," 2022, Collins, https://www.collinsdictionary.com/us/dictionary/english/offset (Year: 2022).*
Office Action (Notice of Reasons for Refusal) dated Sep. 7, 2021, by the Japanese Patent Office in corresponding Japanese Patent Application No. 2017-225956 and an English Translation of the Office Action. (7 pages).

* cited by examiner

VEHICLE DOOR LOCK DEVICE

CROSS REFERENCE TO RELATED APPLICATIONS

This application is based on and claims priority under 35 U.S.C. § 119 to Japanese Patent Application 2017-225956, filed on Nov. 24, 2017, the entire contents of which are incorporated herein by reference.

TECHNICAL FIELD

This disclosure relates to a vehicle door lock device.

BACKGROUND DISCUSSION

Generally, a vehicle door lock device is provided with a remote control device that is provided in the middle of an operation transmitting system between a lock device (fully closing lock, fully opening lock, or like), which binds a door of a vehicle such that the door cannot move, and a door handle (for example, refer to JP 2014-66082A). That is, the door lock device connects or disconnects the operation transmitting system between the lock device and the door handle based on an operation of the remote control device. In addition, when the door lock device connects or disconnects the operation transmitting system, switching between an unlocked state in which it is possible to open the door by operating the door handle and a locked state in which it is not possible to open the door even by operating the door handle (door locked state) is performed.

However, for example, in a case where there is a malfunction of the lock device due to rust or the like, there is a possibility that the door bound by the lock device cannot be released even in a state where the lock device and the door handle are connected by the remote control device. In addition, in such a case, a user may operate the door handle with a strong force such that an excessive load is applied to the remote control device. Therefore, there is still room for improvement.

Thus, a need exists for a vehicle door lock device which is not susceptible to the drawback mentioned above.

SUMMARY

A vehicle door lock device according to an aspect of the disclosure includes a remote control device that is provided in the middle of an operation transmitting system between a lock device, which binds a door of a vehicle such that the door becomes not able to move, and a door handle. A connection member that absorbs an excessive operation force by being elastically deformed in a direction in which the operation force is transmitted is interposed between a transmitting member that transmits an operation force input to the door handle and an input lever on the remote control device side to which the operation force is input via the transmitting member.

BRIEF DESCRIPTION OF THE DRAWINGS

The foregoing and additional features and characteristics of this disclosure will become more apparent from the following detailed description considered with the reference to the accompanying drawings, wherein:

FIG. 30 is a rear view of the connection member.

DETAILED DESCRIPTION

Hereinafter, an embodiment of a vehicle door lock device will be described with reference to drawings.

Figure 1:
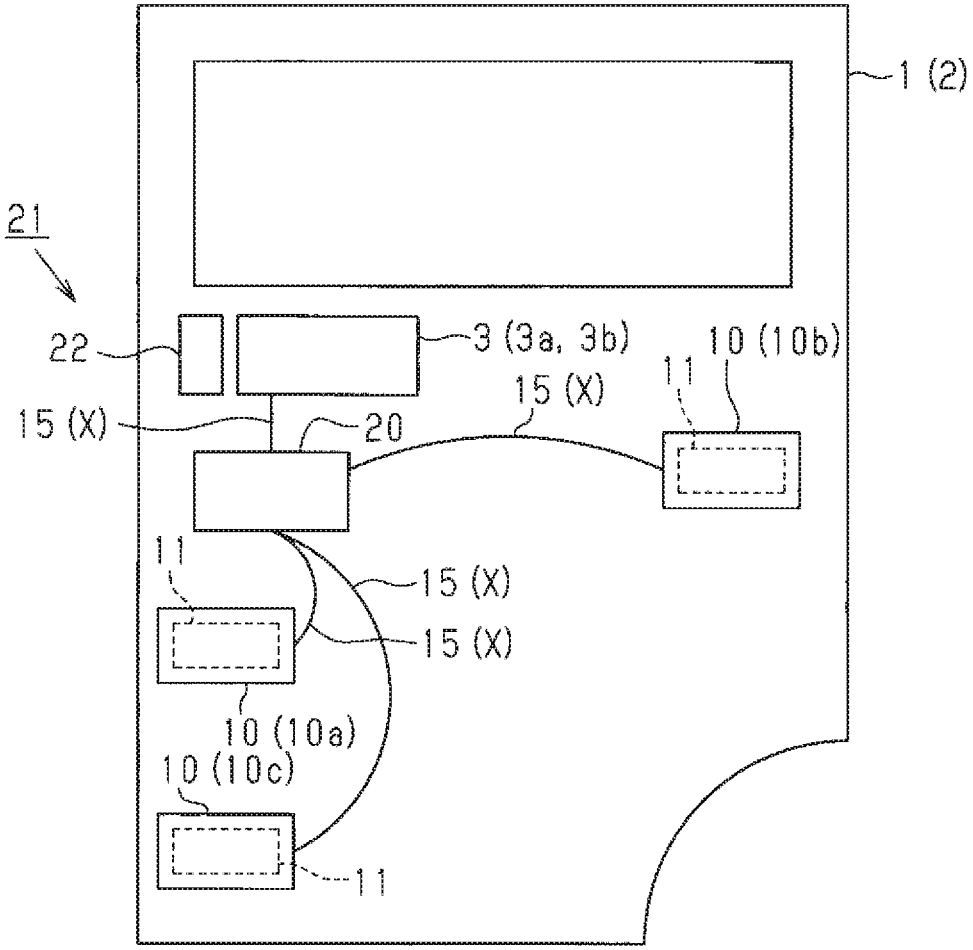
FIG. 1 is a schematic configuration view of a door lock device provided for a door (slide door) of a vehicle.

As illustrated in FIG. 1, a door 1 in the present embodiment is configured as a slide door 2, which can open and close a door opening portion provided in a side surface of a vehicle (not shown) by moving in a vehicle front-rear direction. Specifically, the door 1 is configured to enter a fully-closed state, in which the door opening portion is fully closed, when the door 1 moves toward a vehicle front side (left side in FIG. 1) and to enter a fully-open state, in which an occupant can board or alight via the door opening portion, when the door 1 moves toward a vehicle rear side (right side in FIG. 1). In addition, the door 1 is provided with a door handle 3 (outside door handle 3*a* and inside door handle 3*b*) which is for opening and closing the door 1.

In addition, the door 1 is provided with lock devices 10 that bind the door 1 to a vehicle body with the door 1 being in an unmovable state. Specifically, each lock device 10 in the present embodiment is provided with a latch mechanism 11 that is engaged with a striker (not shown) provided on the vehicle body side so as to bind the striker such that the striker becomes not able to be separated. In addition, the door 1 is provided with a front lock 10*a* and a rear lock 10*b* as a fully closing lock that binds the door 1 at a fully closed position based on an engagement force of the latch mechanism 11. Furthermore, the door 1 is provided with a fully opening lock 10*c* for binding the door 1 at a fully open position based on the engagement force of the latch mechanism 11 in the same manner as described above. In addition, each lock device 10 is configured such that it is possible to release the latch mechanism 11 engaged with the striker provided on the vehicle body side (that is, it is possible to release the door 1 bound in unmovable state) by operating the door handle 3.

Specifically, in the case of the door 1 in the present embodiment, each lock device 10 is mechanically connected to the door handle 3 via a transmitting member 15 such as a wire cable or a link. In addition, the door 1 in the present embodiment is configured such that an operation force on the door handle 3 is transmitted to the latch mechanism 11 of each lock device 10 due to the above-described reason.

In addition, a remote control device (remote controller) 20 that can connect or disconnect an operation transmitting system X formed by the transmitting members 15 is provided between the door handle 3 and the lock devices 10. That is, the door 1 enters a locked state (door locked state) in which the door 1 is bound at the fully closed position when an operation force on the door handle 3 (that is, releasing operation of user) becomes not able to be transmitted to each lock device 10 (10*a* and 10*b*) constituting the fully closing lock based on an operation of the remote control device 20. In addition, the door locked state ends when the operation transmitting system X enters a connected state again based on an operation of the remote control device 20 (unlocked state). In addition, the vehicle provided with the door 1 includes a door lock device 21 formed therein for locking and unlocking the door 1 in this manner.

The remote control device 20 in the present embodiment connects or disconnects the operation transmitting system X between the door handle 3 and the lock devices 10 (10*a* and 10*b*) constituting the fully closing lock when a lock knob 22 provided inside the door 1 or a cylinder key (not shown) open to the outside of the door 1 is operated. In addition, the door lock device 21 in the present embodiment is configured such that it is possible to lock or unlock the door 1 based on an operation of the remote control device 20 by means of an operation input on an operation switch provided in a vehicle cabin, a remote operation which uses wireless communication, or the like as well.

Remote Control Device

Next, the remote control device 20 in the present embodiment will be described.

Figure 2:
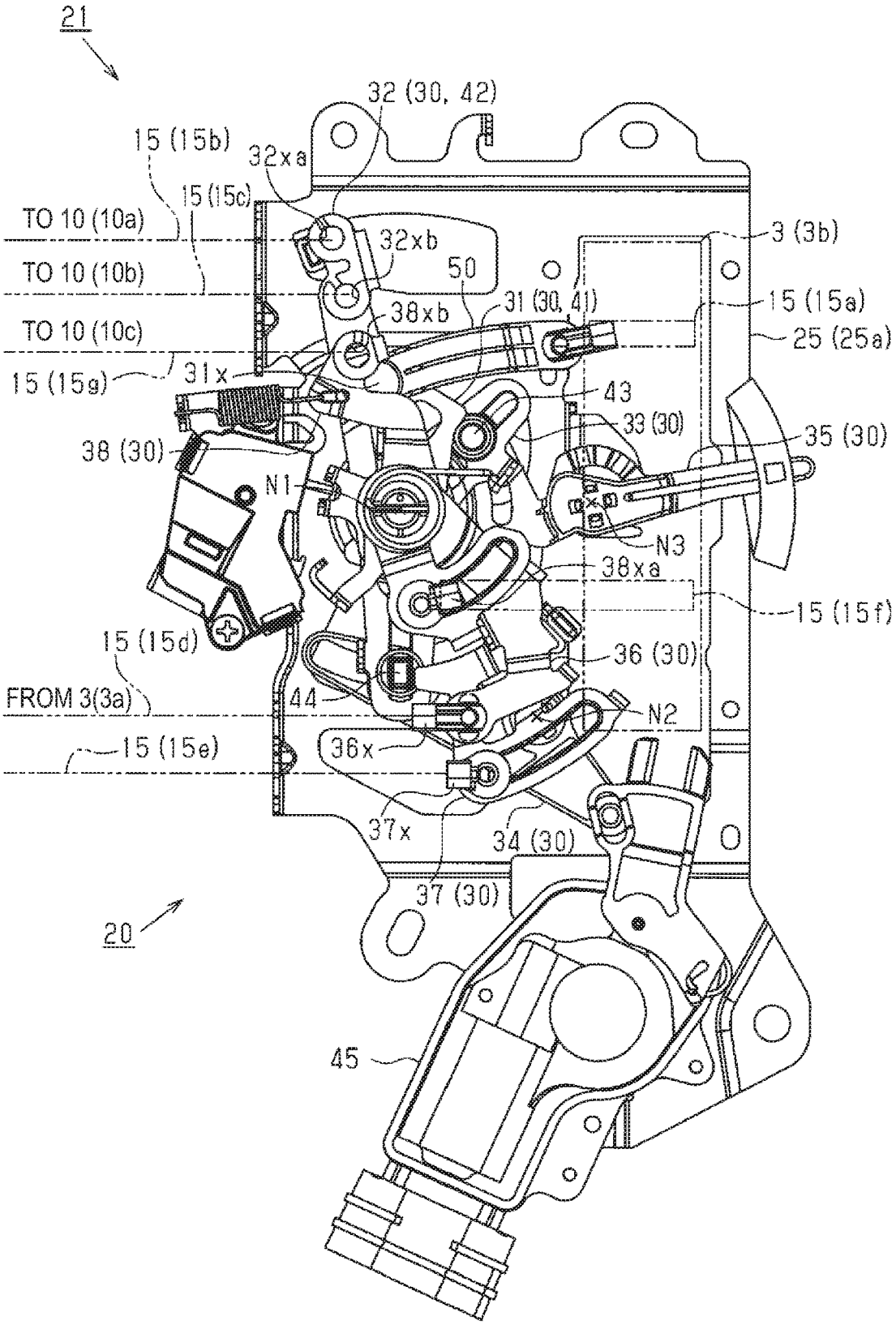
FIG. 2 is a front view of a remote control device (remote controller)

As illustrated in FIG. 2, the remote control device 20 in the present embodiment is provided with a base bracket 25 fixed to the door 1 and a plurality of lever members 30 (31 to 38) supported by the base bracket 25. In addition, the lever members 30 are configured to be interlocked with each other to connect or disconnect the operation transmitting system X between the lock devices 10 provided for the door 1 and the door handle 3.

Specifically, the remote control device 20 in the present embodiment is provided with an inner handle link lever 31. The inner handle link lever 31 is provided with an input portion 31*x* of an operation force that is transmitted via a transmitting member 15*a* connected to the inside door handle 3*b* when the inside door handle 3*b* provided for the door 1 is operated in an opening direction. In addition, the remote control device 20 is provided with a fully closing lock releasing lever 32. The fully closing lock releasing lever 32 is provided with connection portions 32*xa* and 32*xb* for transmitting members 15*b* and 15*c* that extend to the front lock 10*a* and the rear lock 10*b* constituting the fully closing lock as described above. In addition, the remote control device 20 in the present embodiment has a structure in which the inner handle link lever 31 and the fully closing lock releasing lever 32 are rotatably and pivotally supported sharing a spindle N1 erected on the base bracket 25.

In addition, the remote control device 20 in the present embodiment is provided with an open lever 33 that is rotatably and pivotally supported by the spindle N1 along with the inner handle link lever 31 and the fully closing lock releasing lever 32. In addition, rotation of the inner handle link lever 31 constituting an input lever 41 is transmitted to the fully closing lock releasing lever 32, which is an output lever 42, via the open lever 33.

Specifically, in the case of the remote control device 20 in the present embodiment, the inner handle link lever 31 rotates in a clockwise direction in FIG. 2 by being pulled by the transmitting member 15*a* connected to the inside door handle 3*b* in a case where the inside door handle 3*b* is operated in the opening direction. In addition, when the inner handle link lever 31 rotating as described above presses an engagement pin 43 provided in the open lever 33, the open lever 33 is integrally rotated with the inner handle link lever 31. Furthermore, in the remote control device 20 of the present embodiment, the open lever 33 is linked to the fully closing lock releasing lever 32 via a link pin 44. In addition, the remote control device 20 in the present embodiment is configured such that the transmitting members 15*b* and 15*c* extending to the front lock 10*a* and the rear lock 10*b* are pulled when the fully closing lock releasing lever 32 rotates in the clockwise direction in FIG. 2 due to the above-described reason.

That is, in the case of the remote control device 20 in the present embodiment, an operation force with respect to the inside door handle 3*b* that is input to the inner handle link lever 31 is output from the fully closing lock releasing lever 32 in the form of a pulling force. In addition, the door lock device 21 in the present embodiment is configured such that the door 1 bound at the fully closed position is released when the latch mechanism 11 provided in each of the front lock 10*a* and the rear lock 10*b* is unlatched due to the above-described reason.

In addition, the remote control device 20 in the present embodiment is provided with a spindle N2 that is erected on the base bracket 25 to be approximately parallel to the spindle N1 by which the three lever members 30 (31 to 33) are pivotally supported. Furthermore, a locking lever 34 is rotatably and pivotally supported by the spindle N2. In addition, one end of the locking lever 34 is linked to a locking actuator 45.

That is, the locking lever 34 rotates when the locking lever 34 is driven by the locking actuator 45. Furthermore, the locking lever 34 unlinks the open lever 33 and the fully closing lock releasing lever 32, which are linked with each other via the link pin 44, from each other by means of the above-described rotation. In addition, the remote control device 20 in the present embodiment is configured such that rotation of the inner handle link lever 31 becomes not able to be transmitted to the fully closing lock releasing lever 32 due to the above-described reason.

In addition, the remote control device 20 in the present embodiment is provided with a spindle N3 that is erected on the base bracket 25 to be approximately parallel to the spindle N2 and the spindle N1. Furthermore, a child lock lever 35 is rotatably and pivotally supported by the spindle N3. In addition, the remote control device 20 in the present embodiment is configured such that the engagement pin 43 provided in the open lever 33 is moved to a position, at which the engagement pin 43 is not engaged with the inner handle link lever 31, when the child lock lever 35 rotates.

That is, in the remote control device 20 of the present embodiment, the rotation of the child lock lever 35 also causes the rotation of the inner handle link lever 31 to become not able to be transmitted to the fully closing lock releasing lever 32. In the case of the door 1 in the present embodiment, an occupant of the vehicle can operate the child lock lever 35 from the vehicle cabin side. In addition, the door lock device 21 in the present embodiment is configured such that a state in which it is not possible to open the door by operating the inside door handle 3*b*, that is, a locked state (door locked state) in which the door 1 is bound at the fully closed position, is maintained based on the operation of the child lock lever 35 and the locking lever 34.

In addition, the remote control device 20 in the present embodiment is provided with an outer handle link lever 36. The outer handle link lever 36 is provided with a connection portion 36*x* for a transmitting member 15*d* that extends from the outside door handle 3*a*. In the remote control device 20 of the present embodiment, the outer handle link lever 36 is rotatably and pivotally supported sharing the spindle N1 with the inner handle link lever 31, the fully closing lock releasing lever 32, and the open lever 33. Furthermore, the outer handle link lever 36 rotates in the clockwise direction in FIG. 2 by being pulled by the transmitting member 15*d* extending from the outside door handle 3*a* when the outside door handle 3*a* is operated. In addition, the remote control device 20 in the present embodiment is configured that rotation of the outer handle link lever 36 is also transmitted to the fully closing lock releasing lever 32 via the open lever 33.

Furthermore, the remote control device 20 in the present embodiment is provided with a release lever 37. The release lever 37 is provided with a connection portion 37*x* for a transmitting member 15*e* that extends from a release actuator (not shown). In the remote control device 20 of the present embodiment, the release lever 37 is also rotatably and pivotally supported sharing the spindle N1 with the open lever 33, as with the outer handle link lever 36. In addition, the remote control device 20 in the present embodiment is configured such that rotation of the release lever 37 is also transmitted to the fully closing lock releasing lever 32 via the open lever 33 as in the case of the outer handle link lever 36.

In addition, the remote control device 20 in the present embodiment is provided with a fully opening lock releasing lever 38. The fully opening lock releasing lever 38 is provided with a connection portion 38*xa* for a transmitting member 15*f* that extends from the inside door handle 3*b* and a connection portion 38*xb* for a transmitting member 15*g* that extends to the fully opening lock 10*c*. In the remote control device 20 of the present embodiment, the fully opening lock releasing lever 38 is also rotatably and pivotally supported sharing the spindle N1 with the five lever members 30 (31 to 33, 36, and 37). Furthermore, the fully opening lock releasing lever 38 rotates in the clockwise direction in FIG. 2 by being pressed by the transmitting member 15*f* extending from the inside door handle 3*b* in a case where the inside door handle 3*b* is operated in a closing direction. In addition, the remote control device 20 in the present embodiment is configured such that the transmitting member 15*g* connected to the fully opening lock releasing lever 38 is pulled due to the above-described reason.

That is, in the case of the remote control device 20 in the present embodiment, an operation force with respect to the inside door handle 3*b* that is input to the fully opening lock releasing lever 38 is output in the form of a pulling force. In addition, the door lock device 21 in the present embodiment is configured such that the door 1 bound at the fully open position is released when the latch mechanism 11 provided in the fully opening lock 10*c* is unlatched due to the above-described reason.

In the remote control device 20 of the present embodiment, each of the outer handle link lever 36 and the release lever 37 is provided with an engagement portion that is engaged with the open lever 33 such that the open lever 33 can be integrally rotated. Furthermore, the fully opening lock releasing lever 38 is provided with an engagement portion that is engaged with the fully closing lock releasing lever 32 in a case where the fully closing lock releasing lever 32 rotates. In addition, the remote control device 20 in the present embodiment is configured such that the fully closing lock releasing lever 32 and the fully opening lock releasing lever 38 are integrally rotated with each other due to the above-described configuration.

In addition, the door lock device 21 in the present embodiment is provided with a connection member 50 that is interposed between the transmitting member 15*a* extending from the inside door handle 3*b* and the inner handle link lever 31 of the remote control device 20.

Figure 3A:
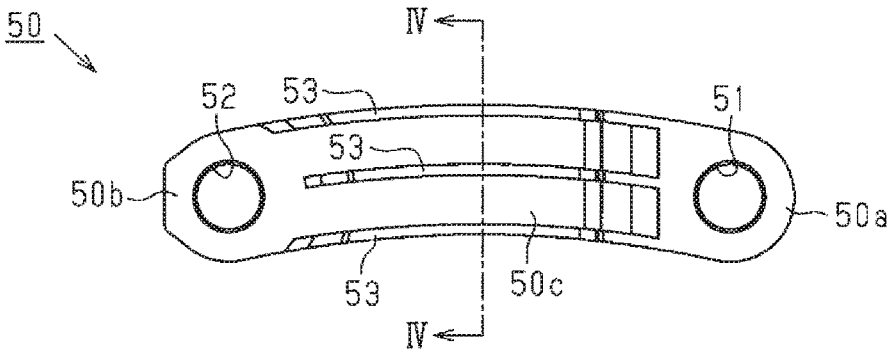
FIG. 3A is a front view of a connection member.
Figure 3B:
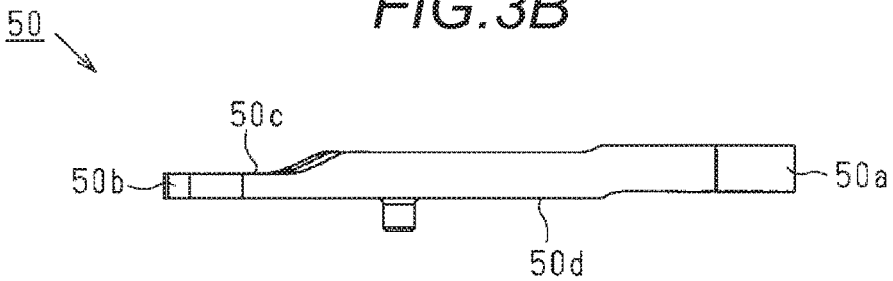
FIG. 3B is a side view of the connection member.
Figure 3C:
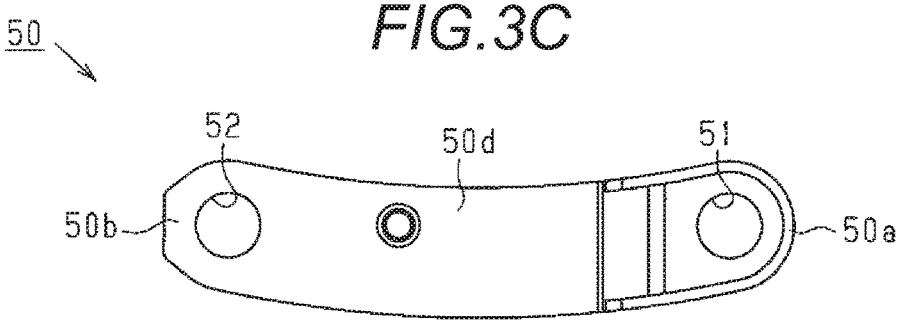

As illustrated in FIGS. 3A to 3C, the connection member 50 in the present embodiment has an approximately elongated plate-like shape. In addition, a first end portion 50*a* of the connection member 50 in a longitudinal direction (lateral direction in FIGS. 3A to 3C) is provided with a hole portion 51 that is used for connection to the transmitting member 15*a*. Furthermore, a second end portion 50*b* of the connection member 50 in the longitudinal direction is provided with a hole portion 52 that is used for connection to the input portion 31*x* of the inner handle link lever 31. In addition, the connection member 50 has a bow-like curved shape (curved plate-like shape) that is curved while extending in a direction in which the two hole portions 51 and 52 are connected to each other, that is, in a direction in which an operation force input to the inside door handle 3*b* is transmitted.

More specifically, the connection member 50 in the present embodiment is formed by using resin.

Figure 4:
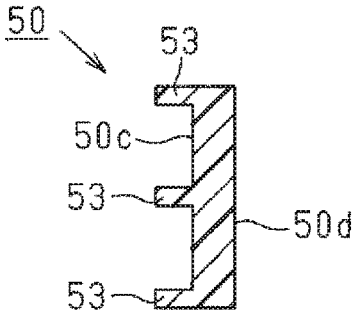
FIG. 4 is a sectional view of the connection member (sectional view taken along line IV-IV in FIG. 3A).

In addition, as illustrated in FIGS. 3A and 4, a front surface 50*c* of the connection member 50 is provided with a plurality of (in present embodiment, three) rib-shaped portions 53 that extend in the longitudinal direction of the connection member 50. In addition, as illustrated in FIG. 2, the connection member 50 in the present embodiment is configured to be disposed along a main body portion 25*a* of the base bracket 25, which has an approximately flat plate-like shape, in a state where a rear surface 50*d* that is opposite to the front surface 50*c* on which the rib-shaped portions 53 are provided faces the base bracket 25 of the remote control device 20.

In addition, the connection member 50 in the present embodiment has a flexibility based on physical properties of resin material with which the connection member 50 is formed. Specifically, the connection member 50 can be elastically deformed in such a manner that the curvature of the bow-like curved shape is changed (bow-like curved shape is extended). In addition, the door lock device 21 in the present embodiment is configured such that the connection member 50 is elastically deformed to absorb an excessive operation force in a case where the inside door handle 3*b* is operated with a strong force (for example, in case where there is malfunction of front lock 10*a* and rear lock 10*b* constituting fully closing lock).

Next, the operation and effect of the present embodiment will be described.

(1) The door lock device 21 is provided with the connection member 50 that is interposed between the transmitting member 15 (15*a*) connected to the door handle 3 (inside door handle 3*b*) and the input lever 41 (inner handle link lever 31) on the remote control device 20 side. In addition, when the connection member 50 is elastically deformed in a direction in which an operation force is transmitted via the transmitting member 15, an excessive operation force input to the door handle 3 is absorbed.

According to the above-described configuration, it is possible to reduce a load on the remote control device 20, which is caused by the door handle 3 being operated with a strong force, with a simple configuration. Accordingly, it is possible to secure a high reliability.

(2) The connection member 50 is formed by using resin.

According to the above-described configuration, it is possible to give a flexibility based on physical properties of resin material with which the connection member 50 is formed, to the connection member 50. Accordingly, it is possible to achieve a configuration in which the transmitting member 15 connected to the door handle 3 and the input lever 41 on the remote control device 20 side are connected to each other in a state where an operation force input to the door handle 3 can be transmitted and the connection member 50 is elastically deformed smoothly in a case where the door handle 3 is operated with a strong force.

(3) The connection member 50 has a bow-like curved shape that is curved while extending in a direction in which an operation force input to the door handle 3 is transmitted. Accordingly, it is possible to elastically deform the connection member 50 smoothly such that the curvature of the bow-like curved shape is changed.

(4) The connection member 50 has a plate-like shape. Accordingly, it is possible to secure a strength needed to transmit the operation force input to the door handle 3 to the input lever 41 from the transmitting member 15 in a state where the connection member 50 can be elastically deformed based on the bow-like curved shape while suppressing an occupied space.

(5) The connection member 50 is provided with the plurality of rib-shaped portions 53 that extend in the direction in which the operation force input to the door handle 3 is transmitted. By adopting the above-described configuration, it is possible to increase the strength of the connection member 50 with a simple configuration. Accordingly, it is possible to achieve reduction in size and weight of the connection member 50.

The above-described embodiment can be implemented by being modified as follows. The above-described embodiment and the following modification example can be implemented by being combined with each other as long as there is no technical conflict.

In the above-described embodiment, the door 1 has a configuration as the slide door 2 which can open and close the door opening portion provided in the side surface of the vehicle by moving in the vehicle front-rear direction. However, the door 1 may be embodied as a door lock device that is used for another type of a vehicle door such as a swing door or a back door.

In the above-described embodiment, the connection member 50 is interposed between the transmitting member 15*a* extending from the inside door handle 3*b* and the inner handle link lever 31 of the remote control device 20. However, the disclosure is not limited to this and for example, the connection member 50 may be interposed between the transmitting member 15*d* extending from the outside door handle 3*a* and the outer handle link lever 36 or between the transmitting member 15*f* extending from the inside door handle 3*b* and the fully opening lock releasing lever 38. That is, the connection member 50 may be interposed between any lever member 30 and the transmitting member 15 as long as the lever member 30 constitutes the input lever 41 on the remote control device 20 side to which an operation force with respect to the door handle 3 is input via the transmitting member 15. In addition, a configuration such as the number of lever members 30 forming the remote control device 20 or disposition thereof may be randomly changed.

In addition, in the above-described embodiment, the connection member 50 is elastically deformed so as to be extended in the direction in which the operation force is transmitted. However, a configuration in which the connection member 50 is disposed such that the connection member 50 is elastically deformed so as to contract in the direction in which the operation force is transmitted may also be adopted.

In the above-described embodiment, the connection member 50 is formed by using resin. However, the disclosure is not limited to this and for example, the connection member 50 may be formed by using other materials such as metal materials. Furthermore, as long as the connection member 50 has such a strength that an operation force input to the door handle 3 can be transmitted to the input lever 41 from the transmitting member 15 and an elastic body can be configured such that the connection member 50 can be smoothly elastically deformed in a case where the door handle 3 is operated with a strong force, the shape of the connection member 50 may also be randomly changed. For example, a shape obtained by bending a bar into a bow-like shape may also be adopted. In addition, a configuration in which the connection member 50 is formed into a coil-like shape may also be adopted.

A vehicle door lock device according to an aspect of the disclosure includes a remote control device that is provided in the middle of an operation transmitting system between a lock device, which binds a door of a vehicle such that the door becomes not able to move, and a door handle. A connection member that absorbs an excessive operation force by being elastically deformed in a direction in which the operation force is transmitted is interposed between a transmitting member that transmits an operation force input to the door handle and an input lever on the remote control device side to which the operation force is input via the transmitting member.

According to the above-described configuration, it is possible to reduce a load on the remote control device, which is caused by the door handle being operated with a strong force, with a simple configuration. Accordingly, it is possible to secure a high reliability.

In the vehicle door lock device, it is preferable that the connection member is formed of resin.

According to the above-described configuration, it is possible to give a flexibility based on physical properties of resin material with which the connection member is formed, to the connection member. Accordingly, it is possible to achieve a configuration in which the transmitting member and the input lever on the remote control device side are connected to each other in a state where an operation force input to the door handle can be transmitted and the connection member is elastically deformed smoothly in a case where the door handle is operated with a strong force.

In the vehicle door lock device, it is preferable that the connection member has a bow-like curved shape that is curved while extending in the direction in which the operation force is transmitted.

According to the above-described configuration, it is possible to elastically deform the connection member smoothly such that the curvature of the bow-like curved shape is changed.

In the vehicle door lock device, it is preferable that the connection member has a plate-like shape.

According to the above-described configuration, it is possible to secure a strength needed to transmit the operation force input to the door handle to the input lever from the transmitting member in a state where the connection member can be elastically deformed based on the bow-like curved shape while suppressing an occupied space.

In the vehicle door lock device, it is preferable that the connection member includes a rib-shaped portion that extends in the direction in which the operation force is transmitted.

According to the above-described configuration, it is possible to increase the strength of the connection member with a simple configuration. Accordingly, it is possible to achieve reduction in size and weight of the connection member.

According to the aspect of this disclosure, it is possible to secure a higher reliability by reducing a load on a remote control device.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door lock device comprising:

a remote control device that is provided in the middle of an operation transmitting system between a lock device, which binds a door of a vehicle such that the door becomes not able to move, and a door handle, and a connection member that is interposed between a transmitting member that transmits an operation force inputted to the door handle and an input lever of the remote control device to which the operation force is inputted via the transmitting member, wherein the connection member has a curved plate shape that extends in a direction in which the operation force is transmitted, is configured to absorb a predetermined operation force by being elastically deformed in the direction in which the operation force is transmitted, and a transmitting member side of the connection member and an input lever side of the connection member are offset such that a center of each side, in a thickness direction of the connection member, are not in line with each other.

2. The vehicle door lock device according to claim 1, wherein the connection member is formed of resin.

3. The vehicle door lock device according to claim 2, wherein the connection member includes a rib-shaped portion that extends in the direction in which the operation force is transmitted.

4. The vehicle door lock device according to claim 1, wherein the connection member includes a rib-shaped portion that extends in the direction in which the operation force is transmitted.

5. The vehicle door lock device according to claim 1, wherein the connection member includes a hole on the transmitting member side of the connection member configured for connecting with the transmitting member, and a rib which surrounds the hole.

* * * * *